US008186294B2

(12) United States Patent
Baylot et al.

(10) Patent No.: US 8,186,294 B2
(45) Date of Patent: May 29, 2012

(54) DEVICE FOR CUTTING OUT AND OPENING/CLOSING AN ORIFICE IN A WALL AT THE BOTTOM OF THE SEA

(75) Inventors: Michel Baylot, Marseilles (FR); Robin Galletti, Venise (IT)

(73) Assignee: Saipem S.A., Montigny le Bretonneux (FR)

( * ) Notice: Subject to any disclaimer, the term of this patent is extended or adjusted under 35 U.S.C. 154(b) by 283 days.

(21) Appl. No.: 12/529,681

(22) PCT Filed: Mar. 3, 2008

(86) PCT No.: PCT/FR2008/050356

§ 371 (c)(1),
(2), (4) Date: Sep. 29, 2009

(87) PCT Pub. No.: WO2008/116997

PCT Pub. Date: Oct. 2, 2008

(65) Prior Publication Data

US 2010/0058967 A1 Mar. 11, 2010

(30) Foreign Application Priority Data

Mar. 2, 2007 (FR) ..... 07 01540

(51) Int. Cl.

| | |
|---|---|
| ***B63B 9/00*** | (2006.01) |
| ***B63G 7/04*** | (2006.01) |
| *B23B 47/00* | (2006.01) |
| *B23B 49/00* | (2006.01) |
| *B23G 1/00* | (2006.01) |

(52) U.S. Cl. ..... 114/221 A; 408/76

(58) Field of Classification Search ..... 405/191; 141/98; 114/21 A, 312, 221 A; 408/76, 72 R, 408/239 R; 137/318

See application file for complete search history.

(56) References Cited

U.S. PATENT DOCUMENTS

| | | | | |
|---|---|---|---|---|
| 3,831,387 | A | 8/1974 | Rolleman | |
| 4,284,110 | A | 8/1981 | Divelbiss et al. | |
| 4,447,952 | A | 5/1984 | Elkins | |
| 7,377,226 | B2 * | 5/2008 | Choi | 114/312 |

FOREIGN PATENT DOCUMENTS

| | | |
|---|---|---|
| DE | 4326500 | 2/1994 |
| EP | 0730543 | 6/1995 |
| EP | 1449762 | 2/2003 |
| EP | 1449762 | 8/2004 |
| EP | 1568600 | 8/2005 |
| WO | WO 2004/087495 | 10/2004 |
| WO | WO 2005/080191 | 9/2005 |

OTHER PUBLICATIONS

International Search Report and Written Opinion, dated Oct. 1, 2009.

* cited by examiner

*Primary Examiner* — Lars A Olson
*Assistant Examiner* — Anthony Wiest
(74) *Attorney, Agent, or Firm* — Cozen O'Connor

(57) ABSTRACT

The present invention relates to a method of cutting (1) a small first orifice (1-1) in a wall (6) at the bottom of the sea and of opening/closing said first orifice, the method comprising anchoring a base (2) that includes a large second orifice (2-1) and a cutter device comprising: a said base, a deformable stopper (3) connected to said base and enabling said large second orifice to be opened or closed depending on the position of the stopper on the base, circular cutter means (4) secured to said base, and anchor means (5) secured to said base and suitable for anchoring said base reversibly on said wall (6). The present invention also provides a method of recovering a viscous fluid that is lighter than water, such as a polluting effluent, and that is contained in a tank of a sunken and/or damaged vessel resting on the sea bottom.

19 Claims, 7 Drawing Sheets

FIG.2C
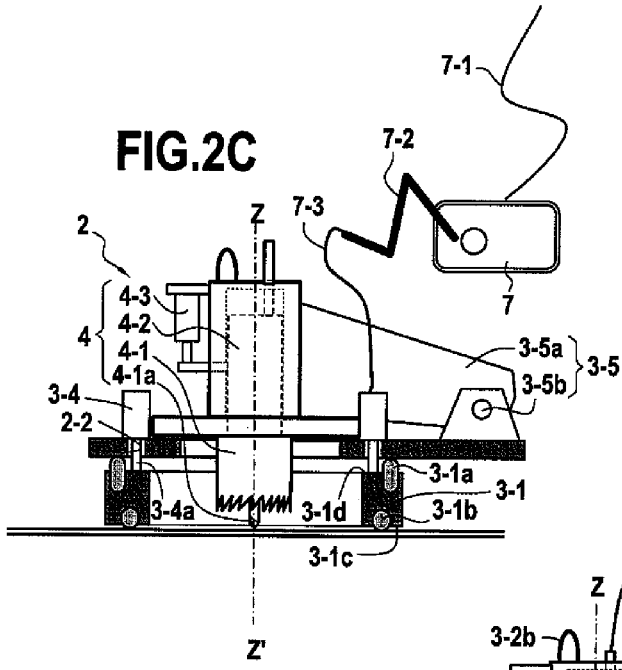
FIG.2D
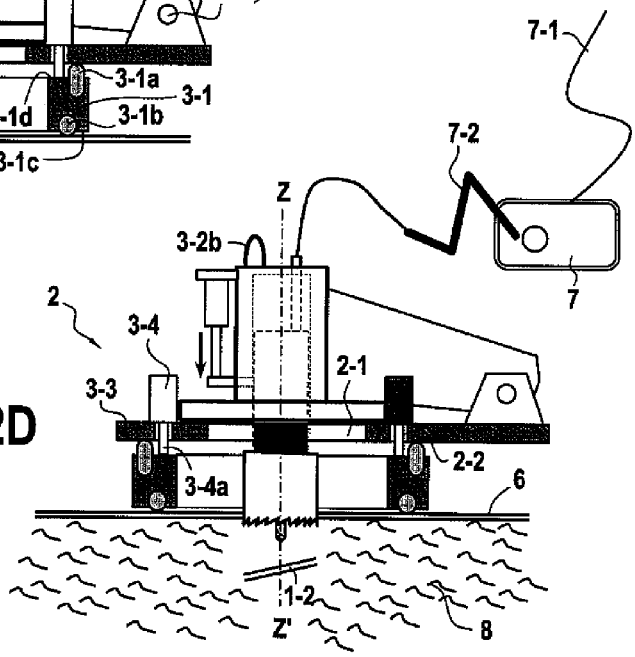
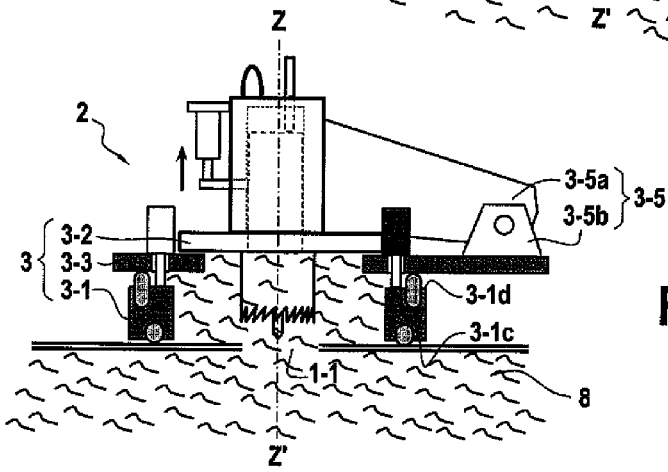
FIG.2E

FIG.3A
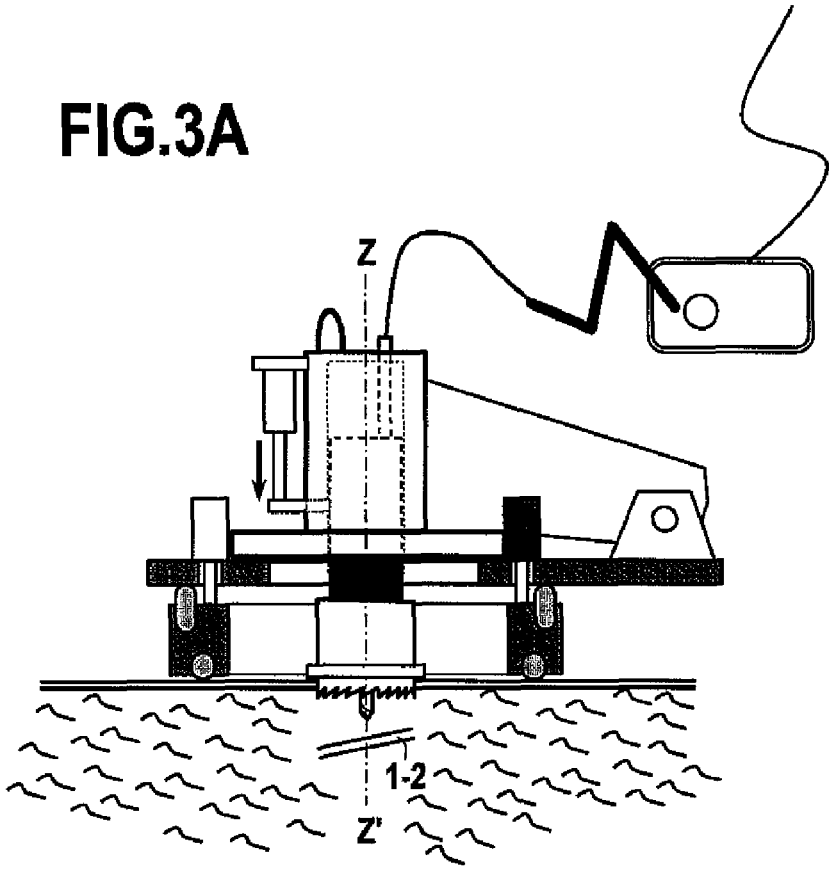
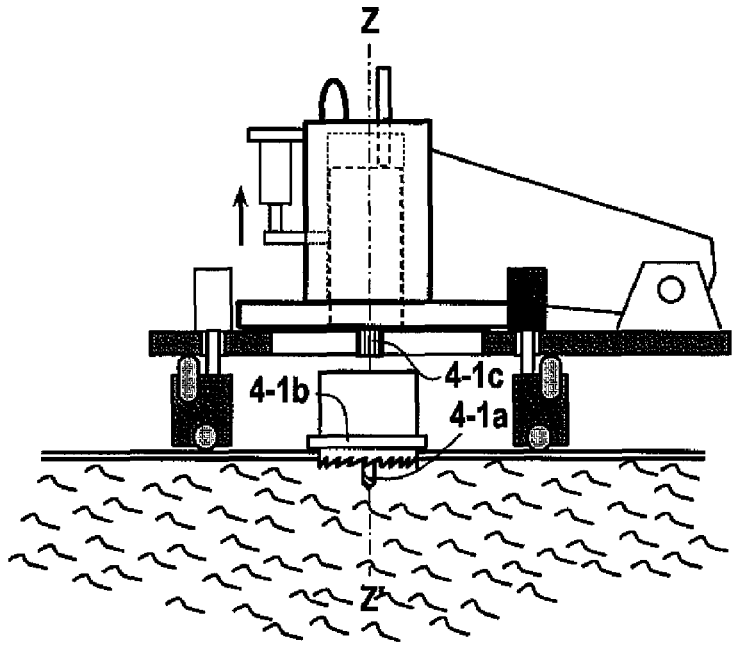
FIG.3B

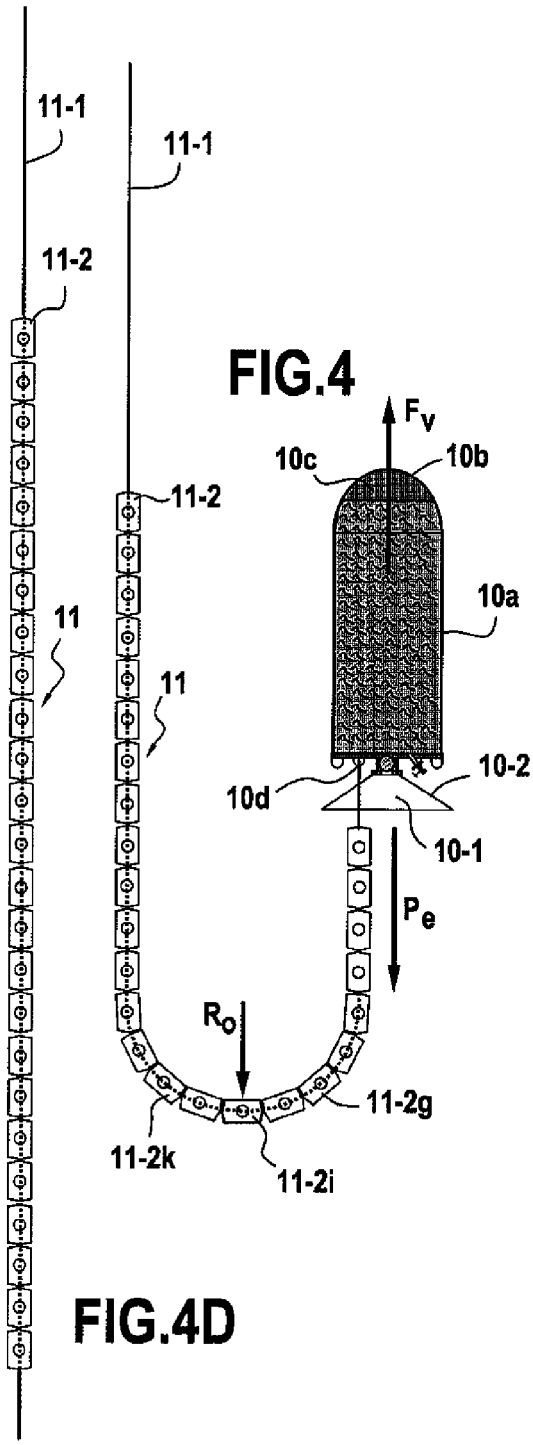
FIG.4
FIG.4D
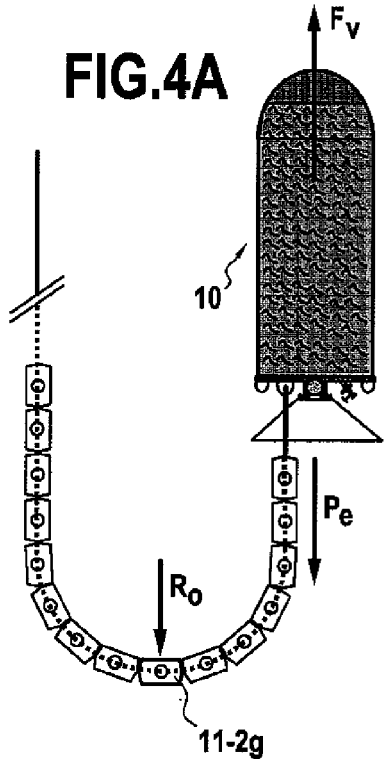
FIG.4A
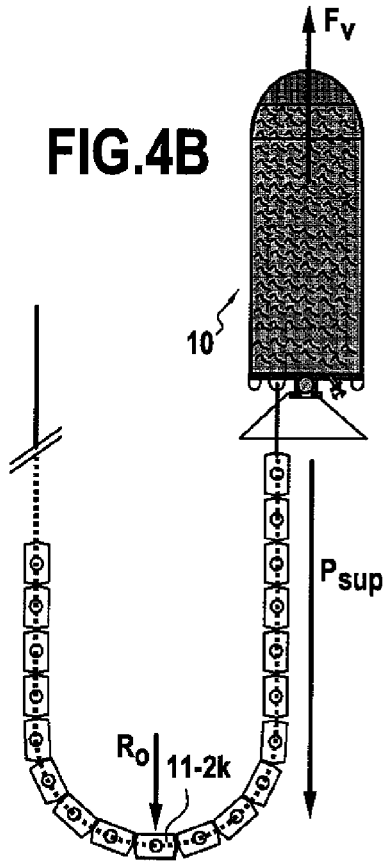
FIG.4B
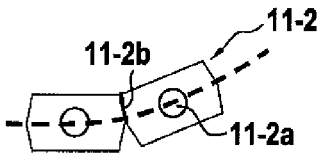
FIG.4C

DEVICE FOR CUTTING OUT AND OPENING/CLOSING AN ORIFICE IN A WALL AT THE BOTTOM OF THE SEA

PRIORITY CLAIM

This is a U.S. national stage of application No. PCT/FR2008/050356, filed on Mar. 3, 2008. Priority is claimed on the following application(s): Country: France, Application No.: 0701540, Filed: Mar. 2, 2007, the content of which is incorporated here by reference.

FIELD Of THE INVENTION

The present invention relates to a device for cutting out a small orifice in a wall at the bottom of the sea and for opening/closing said small orifice.

More particularly, the wall may form part of a wrecked ship or a tank of a wrecked ship on which it is required to take action.

The present invention also provides a method of installing and anchoring a base on a wall at the bottom of the sea and then cutting said wall open, in particular to allow a fluid to pass through the orifice as created in this way in said wall, and be recovered. The method is particularly useful when it is desired to implement a method and an installation for recovering effluents at sea and more particularly polluting effluents contained in a sunken and damaged ship resting on the sea bottom.

BACKGROUND OF THE INVENTION

When a cargo vessel or an oil tanker is shipwrecked, the ship generally sinks after being badly damaged and after losing some of its cargo. When the depth of water is considerable, i.e. 100 meters (m) or 200 m, recovering the wreck or refloating it is generally not envisaged, however the hull must be completely emptied and cleaned so that long-term corrosion of the structure leading to localized or generalized holes will not also lead to the content of the ship being released, thereby creating pollution that may endure over years or even tens of years.

Numerous methods and devices have been studied and used in the past in attempts to recover highly polluting cargoes, either by installing a bottom-to-surface connection for transferring said cargo to a ship on the surface, or else by filling a shuttle reservoir which, once closed, is raised to the surface where it is either loaded on board a surface ship or is towed to a port where it can be emptied.

Patent EP 1 449 763 in the name of the Applicant describes an implementation of a method of recovering polluting effluent contained in a tank of a sunken and/or damaged ship resting on the sea bottom, which effluent is lighter than water and is completely or relatively immiscible with water, the method involving the use of shuttle reservoirs between the bottom and the surface of the sea, each shuttle reservoir being anchored directly to the wall of the tank and co-operating therewith, without there being a base anchored on the wall.

To connect the shuttle reservoir to the wreck, it is possible to use existing orifices, e.g. designed to take samples from a cargo, or indeed to use manholes that are provided for providing access to tanks for maintenance or inspection personnel. But in practice, the wreck is generally broken, and only exceptionally will it be in a horizontal position on the sea bottom. It is often lying on one side or upside-down and it is then impossible to recover its cargo simply, so it has been necessary to make holes through the hull that then make it possible to install and anchor a base on the wall for facilitating extraction operations and for guaranteeing good recovery of the highly polluting cargo, or indeed for enabling the cargo to be taken directly from said holes.

Multiple techniques have been developed in the context of pressurized pipes that are used for hot tapping. In such operations, a pressurized pipe is pierced in a confined environment that withstands pressure, so that there is no risk of the fluid under pressure escaping at any time during the operation.

Multiple variants have been developed so as to simplify the operations of installing the apparatus and in particular so as to avoid the need to weld the tapping body onto the structure under pressure. For this purpose, the tapping body is fastened to the pressurized pipe by mechanical fastening or adhesive, or indeed by means of clamping collars surrounding said pipe, with sealing between them being provided by an elastomer gasket, or better by a metal-on-metal type gasket. However the ability of such devices to withstand traction forces exerted thereon is much less than that needed for securing a base on a wall at the bottom of the sea when said base needs to withstand traction from a shuttle reservoir that is full.

When anchoring a base on a wreck lying on the sea bottom and piercing said wall, providing the depth is small, e.g. 50 m to 100 m, it is advantageous to use divers for performing the tapping, and it is then preferred to connect said tapping to the hull in more secure manner with the help of such divers. However, at greater depth, such interventions become very complex and they are preferably performed by robotic systems, thereby making the task very difficult. It is then preferred to fasten said tapping in mechanical manner, by boring holes through the hull and tapping threads therein so as to enable the base and the tapping supports fitted with an insulation valve to be fastened thereto simply, with an elastomer sealing gasket being compressed between the hull of the wreck and said base or said tapping support.

Patents U.S. Pat. No. 3,831,387 and EP 0 730 543 describe fastening a module or base on a wreck by means of a drilling and tapping device. However, in those systems, the module anchored on the wall is designed to exhaust the cargo from the wreck to the surface by means of a pipe and pumping, such that the amount of traction exerted on the module or base is relatively small.

Thus, in U.S. Pat. No. 3,831,387 and EP 0 730 543, the extraction module that is designed to be connected to a pipe for recovering effluent from a tank at the sea bottom, is anchored thereto by conventional bolting and screwing means.

In EP 0 730 543, the means for drilling the wall and for anchoring thereto in order to fasten said second module are constituted by a system similar to the drill-tap-thread described in U.S. Pat. No. 3,831,387, thus providing limited retention force, particularly with a wreck that is in poor condition.

In EP 1 568 600, proposals are made for a device and a method for drilling and fastening a base on a wall at the bottom of the sea, which device and method are mechanically more reliable and simpler to make and to implement, in particular at great depth, specifically under very severe conditions of use that require a high level of resistance to the traction forces that may be applied to said base when anchored on said wall of a wreck in very poor condition.

When the cargo for recovering from the wreck is relatively fluid, the diameter of the hole in the hull enabling said cargo to be removed can be relatively small, e.g. lying in the range 100 millimeters (mm) to 300 mm, and it is generally satisfactory to use pipes of similar diameter in association with pumping means for transferring the fluid to the surface.

In contrast, when the cargo is extremely viscous and the wreck is situated in very great depths, e.g. more than 1000 m or even more than 3000 m or 4000 m, the method that consists in installing a pipe between the sea bottom and the surface becomes practically impossible because of the very great head loss that occurs along the pipe. Even with extremely powerful pumping at the wreck, flow rates remain low and the risk of creating plugs and blockages in the pipe are high.

That is why it is then preferred to use a shuttle that is lowered from the surface, is filled, and once full is raised to the surface where it is either towed to port, or else emptied into a storage ship, then being lowered back down to the bottom for a new cycle. In order to minimize the number of round trips, it is desirable to increase the unit capacity of such shuttles, and they may represent a volume of 250 cubic meters ($m^3$) to 300 $m^3$, or even more.

Furthermore, for such extremely viscous cargoes, it is desired to avoid using pumps, since they are very difficult to operate at very great depth because of the power they require, and it is then preferred to increase the diameter of the orifice made through the hull so that the crude oil can rise naturally simply because of the difference in density between said crude oil and sea water. Such an orifice may reach a diameter of 700 mm to 800 mm, or even more for very viscous oils, e.g. oils presenting viscosity of 500,000 centistokes (cSt) to 1,000,000 cSt or more.

Thus, the tapping device needs to have a very large through diameter and the machine for drilling the hull must be capable of boring a hole corresponding to said through diameter, i.e. 700 mm to 800 mm, or even more. Consequently it needs to be extremely powerful and to be very firmly secured to the hull in order to stay in position without moving or vibrating throughout the boring stage. In addition, while the shuttle is being filled, the shuttle is positioned vertically over the opening in the hull and it is advantageously secured to said tapping device by a cable, thus representing a high level of traction.

Thus, when the shuttle is filled, because of the difference in density between sea water and crude water, it exerts vertical thrust that may be as great as 20 (metric) tonnes (t) to 30 t for a 300 $m^3$ shuttle; this vertical thrust generates vertical upward traction in said cable connected to said tapping device, and also in the means fastening said tapping device to the hull of the wreck.

For this purpose, EP 1 568 600 provides a device for installing and anchoring a rigid base that is designed to be anchored on a wall at the sea bottom, and for cutting a large orifice in the wall, the device being characterized in that it comprises:

- an upper support structure beneath which said base is secured in reversible manner by means of reversible connection means, said base having cylindrical first orifices;
- said upper structure supporting anchor bolts on said base suitable for being driven in sliding and in rotation through said first orifices of the base;
- said bolts comprising at their ends:
  - first circular cutter means suitable for piercing circular second orifices in said wall; and
  - first means for automatically blocking the base and suitable for anchoring said base on said wall after it has been pierced.

To pierce a second orifice of large diameter centrally in said wall, the device of EP 1 568 600 is characterized in that:

- said upper structure supports second circular cutter means, preferably of the circle cutter or crown saw type, suitable for cutting a large second orifice through the wall centrally about an axis extending in the longitudinal direction ZZ', in particular an orifice of diameter larger than the diameter of said second orifices, and actuator and motor type means suitable for causing said cutter means to slide in said longitudinal direction ZZ' and to be driven in rotation about an axis extending in the longitudinal direction ZZ'; and
- said large central first orifice in the base is positioned to coincide with said second circular cutter means and being suitable for passing said second cutter means while it is sliding longitudinally towards said wall, and said first orifice in the base is suitable for being closed by closure means, preferably of the horizontally-movable guillotine type. Said closure means may be actuatable from the outside, preferably by a remotely controlled robot or "remotely operated vehicle" (ROV), a remotely controlled submarine vehicle, in particular a vehicle that is controlled from the surface or that is actuatable automatically.

In EP 1 568 600, there is also described a method of placing and anchoring a base on a substantially horizontal wall at the sea bottom, and of piercing the wall at the bottom with the help of a device as defined above, the method being characterized in that the following successive steps are performed:

1) a said device is lowered from the surface; and 2) said base is placed on said wall; and 3) said bolts and said first cutter means are actuated in longitudinal sliding towards the wall and in rotation in order to pierce said first orifices in said wall; and 4) said first blocking means are clamped against the inside face of the wall by said movements of said bolts in rotation and in longitudinal sliding in the opposite direction towards the outside of the wall; and 5) said central large second orifice is cut in said wall by causing said second cutter means to move in rotation and in longitudinal sliding towards the wall; and 6) said second cutter means are disengaged by moving in longitudinal sliding in the opposite direction outwards from the wall, preferably by retaining said disk cut out from the wall; and 7) said second orifice in the base is closed with the help of said closure means, preferably of the guillotine type; and 8) said upper structure is separated from said base and said upper structure is raised to the surface.

The complex structure of the device of EP 1 568 600 with an upper structure supporting anchor means and second cutter means for cutting the wall that are different from the first cutter means used for anchoring the base make that device complicated to implement since it requires the upper structure to be separated from the base and to be raised to the surface after the base has been anchored and the bottom wall pierced.

SUMMARY OF THE INVENTION

The object of the present invention is thus to provide a device and a method for piercing a wall at the bottom of the sea and for fastening a base thereto, which device and method are mechanically as reliable as those proposed in EP 1 568 600, but are simpler to make and to implement when piercing a wall at the bottom of the sea and recovering fuel flowing through an orifice pierced with the help of said device in a wall at the bottom of the sea.

Another object of the present invention is to provide a system for recovering fluid from the bottom of the sea without implementing pumping means. More particularly, an object of the present invention is to provide a method and an installation enabling the contents to be recovered from the holds of a ship, e.g. a tanker, that is lying on the sea bottom, in great depths of water, in particular greater than 3000 m or even greater than 4000 m or 5000 m, and that do not present the drawbacks of prior methods and devices, and in particular that are technically more reliable, and easier and simpler to implement.

For this purpose, the present invention provides a device for cutting a small first orifice in a wall at the bottom of the sea and for opening/closing said first orifice, the device comprising a base that has a large second orifice, and being characterized in that it comprises:

- anchor means secured to said base and suitable for anchoring said base reversibly on said wall, maintaining said large second orifice at a distance from said bottom wall;
- a deformable stopper secured to said base and enabling said large second orifice to be opened or closed depending on whether the stopper is respectively in its open or closed position on the base;
- deformer means for deforming said stopper, the deformer means being secured to said base, being independent of said anchor means, and being suitable for deforming said stopper to create sealing between said second orifice and said bottom wall after said base has been anchored on said bottom wall; and
- circular cutter means secured to said base and suitable:
  - for moving through said large second orifice in the base to cut a said small first orifice that is circular beneath said large second orifice when said stopper is in the closed position and said base is anchored on said bottom wall; and
  - for disengaging from said large second orifice to allow said first orifice to be opened when said stopper is in the open position.

It can be understood that when the base is anchored on said bottom wall, after piercing a said first orifice and while said stopper and said cutter means are being moved into a said open or closed position, the device of the present invention makes it possible to close or to open said first orifice, as the case may be, to prevent or to enable fluid transfer through said first orifice, as explained below.

The device of the invention is particularly advantageous since it can be assembled on the surface and lowered on site in a single lowering operation with said base supporting said stoppers and said wall cutter means, together with said anchor means secured to said base, and it can then be held anchored on said wall during and after the operations of cutting open the wall. Furthermore, after the wall has been cut open, it is possible to open or close said large second orifice in the base using a said stopper, without it being necessary to rise said means to the surface, thus enabling said shuttle to travel back and forth to transfer the fuel, as explained below. Where necessary, the device of the invention may be moved in order to pierce another second said first orifice in the wall in order to continue emptying a tank that has been partially emptied via a first said first orifice, without it being necessary to raise all or part of the device as initially installed and anchored on the wall around a first said first orifice.

In the prior art, the base is generally fastened by drilling means followed by screw fastening in the thickness of the steel wall of the wreck. That enables a gasket situated under said base to be flattened sufficiently strongly for the assembly to present good sealing between the large orifice in the base and the bottom wall so as to avoid undesirable leaks of the polluting substance. If leaks do occur, it suffices to tighten said screws so as to compress said gasket further. In a device of the invention, the functions of sealing the large second orifice of the base and of anchoring the base are separated. It is thus possible to use magnets as the anchoring means. The use of magnets makes it necessary firstly to put said magnets into contact with the steel hull, since the magnets produce significant effects only when the gaps separating them from the hull are practically zero, with their capacity for withstanding being torn off vanishing as soon as the space between the magnet and the wall exceeds a few tenths of a millimeter, or perhaps a few millimeters. That is why, in the invention, a deformable stopper is provided, in particular one that includes a deformable gasket, together with means for deforming the stopper, which means are independent of said anchoring means, thus enabling a sealed chamber to be created after the magnets have been activated into contact with the wall of the ship, thereby obtaining maximum ability to withstand being torn off. This is because the magnets would then present sufficient capacity to flatten a gasket over a height of 10 mm to 15 mm or even more remotely under their own action prior to becoming attached to the wall.

It can be understood that said deformer means for deforming said stopper are suitable for creating sealing by deforming said stopper between said large second orifice and said bottom wall after said base has been anchored on a said bottom wall that is not uniformly plane as a result of local deformation or of the presence of a bead of welding.

Another advantage of the present invention is that a device of the invention can be relatively compact, so that it is possible to install a plurality of devices of the invention side by side on a single wall of a leaking tank, as explained below.

If the wall on which it is desired to anchor the base is the wall of a tank that presents a hole through which a polluting fluid contained in the tank is escaping at the sea bottom, said base may be used for fitting any extractor device thereto. More particularly, said base may itself serve to anchor any device and in particular a shuttle reservoir for collecting fluid from a tank having said base anchored on a wall thereof.

In a device for recovering a fluid flowing through an opening in said wall, said base includes a large second orifice that is central and cylindrical in shape about an axis lying in said longitudinal direction ZZ', with a diameter of at least 200 mm, and more particularly a diameter lying in the range 300 mm to 800 mm, and it enables a corresponding small first orifice to be made in the wall having a diameter of 100 mm to 500 mm, and in particular lying in the range 200 mm to 300 mm, for removing a fluid from a tank having said base anchored on a wall thereof.

The present invention is more particularly advantageous for making said first circular orifices with a diameter lying in the range 100 mm to 300 mm.

More particularly, in a device of the invention,

- said base including a platform including a said large second orifice; and
- said stopper comprising:
  - a cylindrical wall defining a said cylindrical chamber disposed axially relative to said large second orifice on the underside of said platform, said cylindrical wall including a top elastomer gasket on its top edge suitable for establishing sealing between said platform and said cylindrical wall, and a bottom elastomer gasket on its bottom edge suitable for establishing sealing between said cylindrical wall and said bottom wall; and
  - a cover-forming plate and tilt means for tilting said cover mounted on said platform, titling said cover enabling said large second orifice to be closed in sealed manner; and
- said cutter means are secured to said cover and comprise a crown saw or bit mounted under said cover and a motor mounted on said cover enabling said crown saw or bit to be caused to slide in the axial direction of said large second orifice and to be actuated in rotation about said axis.

Still more particularly, said base comprises:

a platform including a said large second orifice;

a said cylindrical wall defining a said cylindrical chamber disposed axially about the axis ZZ' of said second large orifice and under said platform; and a said cover and means for tilting said cover that are mounted on said platform.

Advantageously, said cylindrical wall is connected to said platform by fastener means constituted by controlled spacer means for spacing said cylindrical wall apart from said platform and suitable for spacing said cylindrical wall away from said platform to enable said cylindrical wall to be pressed in sealed manner against said wall at the bottom of the sea so as to create a sealed cylindrical chamber between said large second orifice and said bottom wall when said base is anchored on said bottom wall and said cover is in the closed position, by adjusting the force with which the cylindrical wall is pressed against the bottom wall and said elastomer gaskets are compressed.

It is thus possible to create a sealed cylindrical chamber inside the cylindrical wall even when the bottom wall is somewhat deformed. The pressure exerted by the cylindrical wall against the bottom wall with the help of said fastener means enables these deformations to be compensated by flattening the bottom gasket of said cylindrical wall, as explained below.

More particularly, the fastener means are constituted by controlled spacer means for spacing said cylindrical wall relative to said platform, which fastener means are localized and act on three points disposed in a triangle around said large second orifice; and said spacer means are suitable for co-operating with said elastomer gaskets by adjusting the force with which the cylindrical wall is pressed against the bottom wall to create a sealed chamber between the bottom wall, the cylindrical wall and said platform surmounted by said cover in the closed position, whereby:

in an initial close-together position, said top elastomer gasket is compressed; and in a final position of said cylindrical wall spaced apart from said platform, said top elastomer gasket has expanded while maintaining a sealed connection between said cylindrical wall and said platform, and said bottom elastomer gasket is compressed, said cylindrical wall being in sealed connection with said bottom wall.

The thickness of the gaskets and the possibility of varying the thickness by pressing them against the platform and against the bottom wall with the help of said spacer means makes it possible to establish sealing even when the bottom wall is not plane.

Still more particularly, said spacer means comprise actuators or bolts co-operating with screw threads of third orifices through said platform.

In a preferred embodiment, said anchor means comprise block magnets.

More preferably, said block magnets enable said platform to be secured to said bottom wall, said magnets then co-operating with said platform via three bearing points disposed in a triangle around said large second orifice.

More particularly, said magnets are placed around said cylindrical wall and they hold said platform at a distance from said bottom wall. Thus, when said magnets are secured to said bottom wall and when said cylindrical wall is secured to said platform on the underside thereof, with said upper gasket being compressed, then said bottom elastomer gasket is somewhat spaced apart from or in contact with said bottom wall, and said controlled spacer means enable the force with which the cylindrical wall is pressed against the bottom wall in order to create a sealed chamber between the bottom wall, the cylindrical wall, and said platform surmounted by said cover in the closed position.

It will be understood that the distance between the platform and the bottom wall is thus slightly greater than the height of the cylindrical wall once the magnets have been activated to secure the platform and the cylindrical wall to said bottom wall.

By activating said spacer means, it is thus possible to control the force with which the cylindrical wall is pressed against the bottom wall for piercing, as a function of the regularity of said wall. In particular, this makes it possible to exert a maximum thrust if the sheet metal of the wall for piercing is deformed.

Advantageously, the device of the invention comprises four magnets disposed in a rectangle and co-operating with said platform via three zones:

two first magnets being mounted securely to the underface of said platform and on one side of said rectangle; and two second magnets being disposed outside said platform being connected to each other by a connection arm hinged to pivot about a middle transverse axis embodied by at least a first end of a second connection arm secured to said platform;

said magnets being activatable by actuating respective levers.

It will be understood that said two first magnets are directly secured to the platform via two different zones, while the two said second magnets are secured to said platform via the second end of said second connection arm, i.e. a single common zone of said platform.

This system of four magnets that co-operate with said platform via three points constitutes an isostatic system for fastening said platform on said bottom wall.

Buoyancy elements may be incorporated in the device for installing and anchoring a base of the invention in order to control its buoyancy, in particular while it is being lowered to the bottom of the sea from the surface, so that this takes place in hydrostatic equilibrium, and also when approaching and placing the device of the invention on the wall that is to be pierced. This approach and spacing may be performed with the help of an external operator, and in particular by means of an ROV, particularly if the device of the invention needs to be tilted in order to be anchored on a wall that is steeply sloping, or a wall that is vertical.

Nevertheless, if the device is to be installed on a top wall of an element at the bottom of the sea, in particular on a tank or on a ship at the sea bottom, with said top wall being substantially horizontal, then the device for installing and anchoring a base of the invention may be placed directly thereon without help from an external operator.

The term "substantially" horizontal is used herein to meant that said wall may be sloping, providing it is possible to place said base thereon in a manner that is sufficiently stable to enable it to be anchored thereto.

Advantageously, all or some of said cutter means, said anchor means of the base, said fastener means for fastening said cylindrical wall to said platform, and said tilt means for tilting said cover are suitable for being actuated by an ROV.

The present invention also provides a method of placing and anchoring a base on a substantially horizontal wall at the bottom of the sea and of cutting a said bottom wall with the help of a device according to the invention, characterized in that the following successive steps are performed:

1) lowering a said device according to the invention from the surface, said stopper being in its position for closing said large second orifice; and 2) anchoring said base on said bottom wall; and 3) deforming said stopper in such a manner as to establish sealing by deformation of said stopper between said large second orifice and said bottom wall after said base has been anchored on said bottom wall; and 4) actuating said cutter means in longitudinal sliding towards said bottom wall and in rotation to cut a said first orifice in said wall, said stopper being in said closed position.

More particularly, after said cutting of step 4), the following subsequent step is performed:

5) actuating said cutter means to slide longitudinally in the opposite direction while maintaining said cylindrical wall, where appropriate, pressed against said bottom wall in sealed manner, said stopper continuing to be in said position closing said large second orifice.

The present invention also provides a method of recovering a viscous fluid that is lighter than water, such as a polluting effluent, the fluid being contained in a tank of a sunken and/or damaged ship lying on the sea bottom, the method comprising the following steps:

1) performing the method of placing and anchoring a base and drilling the wall of said tank by a method of placing and anchoring a base on a bottom wall and cutting said bottom wall in accordance with the invention; and 2) lowering a said shuttle reservoir from the surface to above said base; and 3) anchoring said shuttle reservoir on said bottom wall or said base so that the bottom opening of said shuttle reservoir is positioned close to and above said large second orifice of said base; and 4) opening said large second orifice of said base with said stopper in said open position, and allowing said fluid contained in the tank to flow naturally into said shuttle reservoir through the bottom opening of said shuttle reservoir; and 5) when said shuttle reservoir is full of fluid, raising said shuttle reservoir to the surface after closing said small first orifice and said large second orifice in said base with the help of said stopper in said closed position; and 6) storing said shuttle reservoir full of fluid in a surface ship and/or emptying said shuttle reservoir into said ship, and/or transporting it to a site for emptying; and 7) where appropriate, repeating steps 1) to 6) with the same shuttle reservoir or with another shuttle reservoir until the desired quantity has been recovered, said cutter means and said stopper continuing to remain secured to said base anchored on said bottom wall.

More particularly, the following additional steps are performed:

1a) a method of placing and anchoring a base and of cutting the bottom wall of the same tank is performed with the help of a second device for anchoring a base and cutting a wall in accordance with the invention, and cutting a second said first orifice, preferably in the same wall as the first said first orifice using a method of the invention; then 2a) opening said large second orifice in the base of said second device and introducing means into the second said first orifice in said drilled bottom wall, said means enabling sea water to be introduced into the bottom of said tank as said viscous fluid flows from the tank towards said shuttle reservoir through the first said first orifice.

Advantageously, in the above method, in step 2a), a cannula is inserted that extends to the proximity of the bottom of the tank, said cannula being provided with a valve close to its top end, and preferably also a safety valve enabling any excess pressure in the tank to be avoided, said cannula sliding as a tight fit through a coupling piece, which coupling piece provides a sealed coupling between said cannula and the second said first orifice.

More particularly, in the method of the invention, the following steps are performed:

after step 1a) of cutting a second said first orifice in said bottom wall, the cutter means of the second said device are left in place on the bottom wall so as to keep the second said first orifice closed by said cutter means plugging said first orifice with the help of retaining means, then in step 2a), said coupling piece is at least partially funnel-shaped and said cannula is introduced by force into said funnel until said coupling piece is in sealed connection with the second said large second orifice, and then said cannula is caused to slide relative to said coupling piece by forcing said cannula against said cutter means until said retaining means give way and allow said cutter means to drop into the tank, and then continuing to cause said cannula to slide until the bottom end of said cannula comes into the proximity of or rests against the bottom of the tank, and then opening said top valve, which, until then, has been in a closed position.

BRIEF DESCRIPTION OF THE DRAWINGS

Other characteristics and advantages of the present invention appear better on reading the following description made by way of non-limiting illustration and with reference to the accompanying drawings, in which:

FIG. 2C corresponds to FIG. 2B, said cylindrical wall of the sealing chamber being shown in the deployed position;

FIG. 2D is a side view in partial section showing the drilling of the hull of the wreck, the tool penetrating into the reservoir, with the cut-off steel disk dropping to the bottom of said tank;

FIG. 2E corresponds to FIG. 2D, the cutter tool being in the retracted position, thereby releasing a passage for the polluting fluid, which fluid then fills the sealed chamber completely;

FIGS. 3A to 3F are side views showing the various cutting or boring sequences performed on the wall in order to install a device for injecting sea water into the bottom of the tank of the wreck;

FIG. 4 is a side view of a shuttle reservoir stabilized while it is rising by means of a connection cable weighed down by blocks secured thereto and also acting as means for limiting curvature;

FIGS. 4A and 4B show states similar to that of FIG. 4, the shuttle reservoir being shown rising in FIG. 4A and descending in FIG. 4B;

FIG. 4C is a detail view showing two blocks coming into contact when said cable is curved; and FIG. 4D shows the spring of blocks when simply suspended in a vertical position.

DETAILED DESCRIPTION OF THE PRESENTLY PREFERRED EMBODIMENTS

Figure 1:
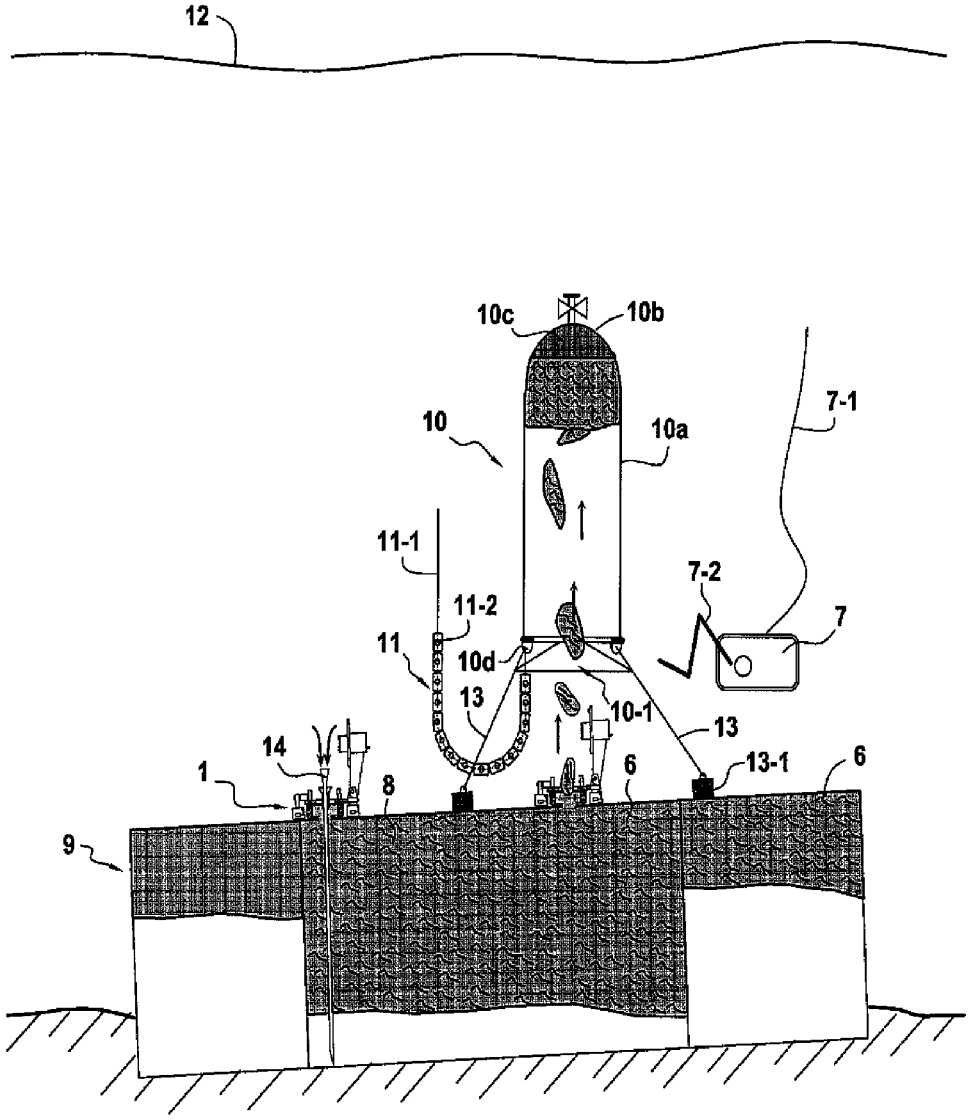
FIG. 1 is a section in side view of a tank or of a wreck having installed thereon a shuttle reservoir stabilized vertically above a hole in a hull made with the help of the cutter device of the invention, said shuttle being in the process of being filled.

FIG. 1 is a side view in section of the wreck of a ship containing polluting substances, such as heavy fuel 8, stored in the tanks 9 of said ship, and two devices 1 of the invention that have enabled the hull 2 to be drilled at two locations. Each of these devices includes a tilting cover shown in the open position, but also suitable for closing the orifice. The shuttle reservoir 10 having a capacity of 150 $m^3$ is positioned vertically above a first said device 1 of the invention and it receives the polluting substance 8 that escapes from said tank and that moves vertically upwards at slow speed, given its density which remains less than the density of sea water. Said shuttle 10 is held laterally by cables connected to deadweight blocks 13-1 weighing 250 kilograms (kg), merely placed on the wall 6 of the ship, the vertical forces due to the buoyancy of the reservoir 10 are counterbalanced by a handling and stabilizing device 11 with heavy blocks 11-2 described below with reference to FIGS. 4 and 4A to 4D. At the top of the shuttle, a valve 10*e* isolates a connection pipe (not shown) serving, when the shuttle is close to the surface of the water, to connect an emptying hose to transfer, preferably with the help of a pump, the content of the shuttle to a storage ship, such as a tanker.

Said shuttle reservoir 10 comprises a flexible or rigid main envelope 10*a* having a cylindrical peripheral wall surmounted by a rigid dome 10*b* presenting a bullet-like profile in vertical section, said dome preferably containing buoyancy elements 10*c* such as syntactic foam enabling the shuttle to descend when empty and enabling its return to the surface to be controlled solely by the action of buoyancy, preferably with the center of buoyancy of said shuttle reservoir full of fluid being offset upwards from its apparent center of gravity in water.

The device 1 for cutting a small first orifice 1-1 in the wall 6 at the sea bottom and for opening/closing said first orifice, as shown in FIGS. 1 to 3, comprises a base 2 comprising a large plate or platform 3-3 including a central second orifice 2-1 of large diameter. Said base includes a stopper 3 enabling said large second orifice to be opened or closed depending on the position of the stopper relative to the base. The stopper is constituted by:

- a cylindrical wall 3-1 around and beneath said large second orifice 2-1, said cylindrical wall defining a cylindrical chamber; and
- a plate constituting a tilting cover 3-2 above said platform 3-3. The cover 3-2 includes a circular peripheral gasket on its underside 3-2*a* going around the large second orifice 2-1 when the cover rests flat on the platform over said large second orifice. Tilting said cover thus serves to close said large second orifice in leaktight manner.

Figure 2A:
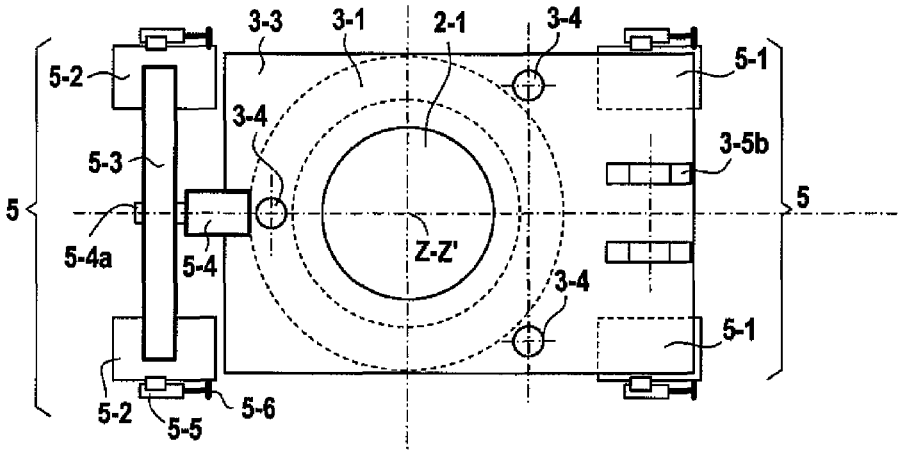
FIG. 2A is a fragmentary plan view of a shuttle device of the invention, the top portion including a pivoting cover and the cutter tool not being shown.
Figure 2B:
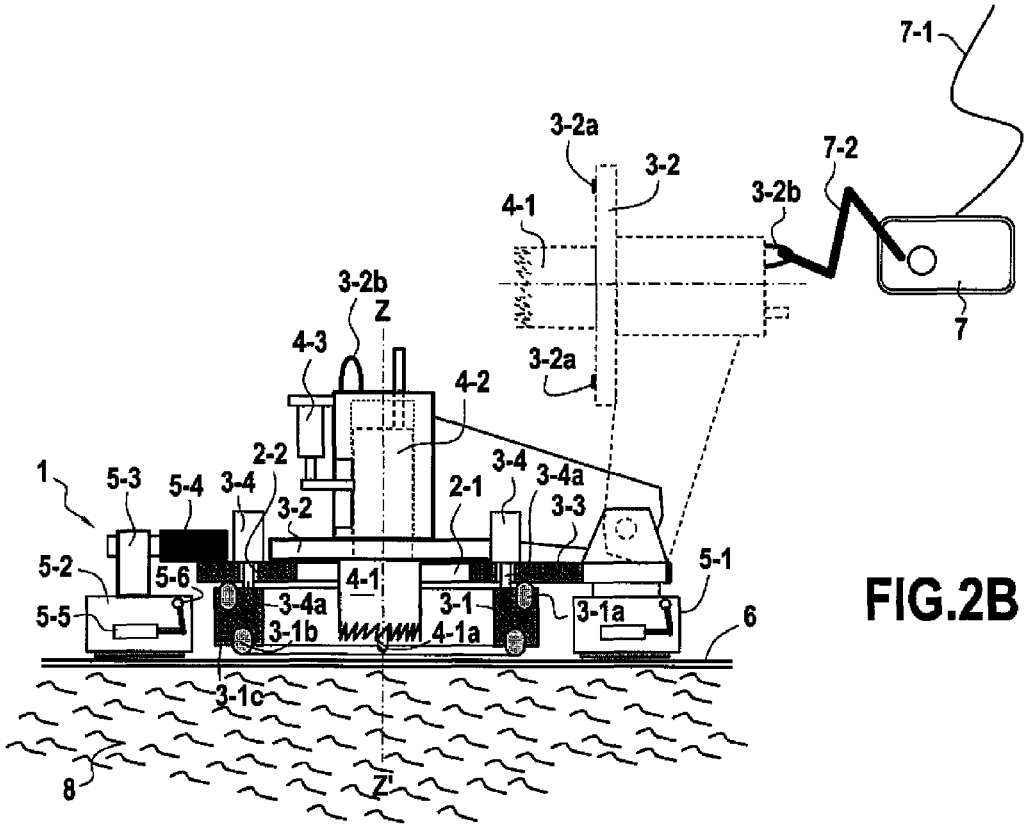
FIG. 2B is a side view, partially in section, relative to FIG. 3A, in which there can be seen the top portion including the pivoting cover and the cutter tool, the cylindrical wall defining a sealing chamber being shown in the retracted position.

FIGS. 2A and 2B show a cutter device of the invention constituted by a main platform 3-3 with a substantially central orifice 2-1.

The cover-forming plate 3-2 supports circular cutter means 4 comprising a crown saw or bit 4-1 mounted under said cover, and an actuator 4-3 and a motor 4-2 mounted on said cover. Said actuator 4-3 serves to actuate a rod that causes the crown saw 4-1 and the motor 4-2 to slide in translation relative to the cover 3-2 through said large second orifice in the axial section ZZ' of said large second orifice. The motor 4-2 serves to drive the crown saw in rotation about the same axis of rotation ZZ'.

The cover-forming plate 3-2 and the cutter means 4 are tilted together by tilt means 3-5 comprising a connection element 3-5*a* having one end hinged to pivot about an axis parallel to said cover 3-2 via yokes 3-5*b* resting on the platform 3-3, and having its other end secured to said cover via a top structure containing said motor 4-2 and to which said actuator 4-3 for moving the motor 4-2 in translation is secured.

The crown saw 4-1 is suitable:

- for moving in translation through said large second orifice 2-1 to cut a said small first orifice 1-1 of circular shape in the wall 6 beneath said large second orifice, when said stopper 3-2 is in the closed position and said base is anchored on said bottom wall 6; and
- for disengaging from said large second orifice in order to enable said first orifice to open when said stopper in the open position.

Said cylindrical wall 3-1 is connected to said platform 3-3 by fastener means comprising three actuators 3-4 resting on said platform 3-3 outside the cover 3-2 and placed in a triangle around said large second orifice. The rods 3-4*a* of these actuators 3-4 pass through third orifices 2-2 in the platform 3-3 and they are secured to the top edge of the cylindrical wall 3-1. These fastener means also constitute means enabling the spacing between the cylindrical wall 3-1 and the platform 3-3 to be varied. These spacer means combined with elastomer gaskets on the top and bottom edges 3-1*d* and 3-1*c* of the cylindrical wall 3-1 enable the pressure exerted by the cylindrical wall 3-1 against the bottom wall 6 to be adjusted as a function of irregularities in the shape of the bottom wall 6. Said flexible elastomer gaskets comprise:

- a top elastomer gasket 3-1*a* between said platform 3-3 and said cylindrical wall 3-1; and
- a bottom elastomer gasket 3-1*b* between said cylindrical wall 3-1 and said bottom wall 6.

Said spacer means 3-4 co-operate with said elastomer gaskets in such a manner that:

- in the initial, close-together position, said top elastomer gasket 3-1*a* is compressed, said bottom gasket being expanded, said bottom gasket possibly being in leaktight contact with said bottom wall 6; and
- in the final, spaced-apart position of said cylindrical wall away from said platform, said top elastomer gasket 3-1*a* is expanded while maintaining a leaktight connection between said cylindrical wall and said platform, and said bottom elastomer gasket 3-1*b* is compressed, said cylindrical wall being in leaktight connection with said bottom wall 6.

The spacer means 3-4 and the gaskets 3-1*a* and 3-1*b* enable said cylindrical wall 3-1 to be pressed in leaktight manner against said wall 6 at the bottom of the sea, so as to define a said leaktight cylindrical chamber when said cover 3 is in the closed position, even in the event of the bottom wall being deformed at this position, or in the presence of weld beads.

The cylindrical wall 3-1 may be constituted by a portion of thick tube 3-1 actuated to move in translation by three hydraulic or mechanical actuators 3-4 that are synchronized so that the bottom edge 3-1*c* of the tube is pressed against the wall of the tank, flattening the second flexible elastomer gasket 3-1*b*, which gasket thus provides sealing for the chamber even in zones of welding or irregularity of the wall, with the maximum irregularity that can be accommodated being of the order of 10 mm to 15 mm. When the tube 3-1*c* is in the low position, the first flexible elastomer gasket 3-1*a* expands and continues to provide sealing relative to the main platform 3-3.

The platform 3-3 co-operates with anchor means 5 having magnets 5-1 and 5-2 secured to said platform 3-3 and suitable for anchoring said base reversibly on said wall 6.

Four magnets 5-1, 5-2 are located rectangularly around said cylindrical wall 3-1, two first magnets 5-1 being secured under said platform 3-3 and on the same side as said rectangle, and two second magnets 5-2 are located outside said platform 3-3, being connected to each other by a connection arm 5-3 hinged to pivot about a middle transverse axis embodied by at least a first end 5-4*a* of a second connection arm 5-4 secured to said platform. These four magnets thus co-operate with said platform via three bearing points arranged as a triangle around said large second orifice 2-1 to form an isostatic system for fastening said platform on said bottom wall, which is advantageous in the event of said bottom wall 6 being deformed.

Said magnets are magnetically activatable by actuating a lever 5-6 using actuators 5-5 and secured with said platform 3-3 in permanent manner, and with the wall 6 in reversible manner.

The block magnets 5-1 and 5-2 having high-capacity grip, with each of them being put into action by a hydraulic actuator 5-5 acting on a lever 5-6, are known to the person skilled in the art. They generally comprise a lever actuated by hand and they enable magnetic parts to be positioned on machines, for the purpose of machining them. The highest performance magnets have traction capacities of 500 kg to 750 kg, or even more, when they are applied to plane magnetic surfaces that are suitably brushed and not covered in paint.

It can be understood that the heights of the block magnets 5-1 and 5-2, and thus the distance between the platform and the bottom wall when the magnets are activated and secured to the wall 6, are slightly greater than the height of the cylindrical wall so as to enable the compression of the bottom gasket to be adjusted, and thus enable the pressure applied by the cylindrical wall 3-1 against the wall to be adjusted, as explained above. By actuating said spacer means, it is thus possible to control the force with which the cylindrical wall is pressed against the bottom wall that is to be drilled, as a function of the regularities of the wall. This makes it possible in particular to exert maximum thrust if the sheet metal of the wall for drilling is deformed, so as to compress the gasket 3-1*b* properly and establish sealing between the cylindrical wall 3-1 and the bottom wall 6, while maintaining sealing between the cylindrical wall 3-1 and the platform 3-3 at the top end 3-1*d*.

An ROV 7 that is powered and controlled from the surface 12 via a link 7-1 serves to actuate an articulated arm 7-2 for the purpose of using a power supply connection 7-3 to control and actuate as appropriate the following various elements: the motor 4-2 and the actuator 4-3 of said cutter means 4; the actuators 5-5 of said means for anchoring the base 5; the actuators 3-4 of said means for fastening and spacing said cylindrical wall relative to said platform; and said means 3-5 for titling said cover. In FIG. 2B, the arm 7-2 of the ROV co-operates with a ring 3-2*b* of the cover in order to cause it to tilt or pivot.

The method of placing and anchoring a base on a substantially horizontal wall at the bottom of the sea, and of drilling a said bottom wall with the help of a device of the invention comprises the following successive steps:

1) lowering a said cutter device 1 of the invention from the surface, said cover 3-2 being in its position for closing said large second orifice; and 2) anchoring said base 2 on said bottom wall 6; and 3) pressing said cylindrical wall 3-1 against said bottom wall so as to create a leaktight cylindrical chamber between said closed cover, said cylindrical wall, and said bottom wall 6, by adjusting the compression of said gaskets 3-1*a* and 3-1*b*; and 4) actuating said cutter means 4 to slide longitudinally along the axis ZZ' towards said bottom wall 6 and to rotate so as to drill a said first orifice 1-1 in said wall, said stopper 3 being in said closed position; and 5) actuating said cutter means to slide longitudinally along the axis ZZ' in the opposite direction while maintaining said cylindrical wall 3-1 pressed in leaktight connection against said bottom wall, where appropriate, said stopper remaining in said position for closing said large second orifice.

The cutter tool 4 or borer includes motor means 4-2, preferably hydraulic motor means, with power then being delivered by the ROV via a go-and-return hydraulic hose 7-3, said motor 4-2 being capable of moving downwards along the vertical axis ZZ', downward movement being driven, for example, by a hydraulic actuator 4-3 also powered by the ROV, and thus controlled from the surface by an operator. At the bottom end of said motor, the crown saw 4-1 is installed on the drive shaft and includes at its center a pilot drill bit 4-1*a*.

As can be seen in FIG. 2B, with the cover 3-2 shown in its raised position in dashed lines, said cover includes on its under face a preferably elastomer gasket 2-3*a* that, when said cover is resting on the main platform 3-3, provides complete sealing of the circular chamber, thus preventing any leak of polluting fluid via the junction between the platform 3-3 and the cover 3-2 around the large orifice 2-1.

Thus, at the beginning of boring, as shown in FIG. 2C, the centering bit 4-1*a* passes through the sheet metal of the wall 6 of the tank 9 with the power delivered by the motor 4-2 remaining low. As soon as the crown saw 4-1 engages the sheet metal, the amount of power required becomes large, and even in the event of the surface presenting an irregularity, e.g. as a result of a thick weld bead, the crown saw 4-1 remains centered. At the end of boring, the cut-out washer 1-2 either drops to the bottom 6-1 of the tank, or else remains jammed between the centering bit and the crown saw. The motor and the crown saw are then raised to the maximum in translation as shown in FIG. 2E. The polluting fluid then penetrates completely into the leaktight chamber and the device is ready to load the shuttle, as described below.

The method of recovering a viscous fluid such as a polluting effluent that is lighter than water and that is contained in the tank of a sunken and/or damaged ship resting on the sea bottom, comprises the following steps:

1) placing and anchoring a base and drilling the wall of said tank using the above method; and 2) lowering a said shuttle reservoir 10 from the surface 14 to above said base 2; and 3) anchoring 13 said shuttle reservoir to said bottom wall 6 or said base so that the bottom opening 10-1 of said shuttle reservoir is positioned close to and above said large second orifice 2-1 of said base; and 4) opening said large second orifice 2-1 of said base with said stopper in said open position, and allowing said fluid contained in the tank to flow naturally into said shuttle reservoir through the bottom orifice of said shuttle reservoir; and 5) when said shuttle reservoir is full of fluid, raising said shuttle reservoir to the surface after closing said small first orifice 1*a* and said large second orifice 2-1 of said base with the help of said stopper 3 being placed in said closed position; and 6) storing said shuttle reservoir full of fluid in a surface ship and/or emptying said shuttle reservoir into said ship, and/or transporting it to a site where it is emptied; and 7) where appropriate, repeating steps 1) to 6) with the same shuttle reservoir or with another shuttle reservoir until the desired quantity has been recovered, said cutter means and said stopper continuing to remain secured to said base anchored on said bottom wall.

Throughout the stage of emptying a tank, the motor, and the crown saw, possibly with the unplugging sheet metal washer 1-2 jammed therein, remain secured to the cover 3-2. The shuttle 10 is then positioned vertically above the device as shown in FIG. 1, and the cover is tilted by means of the hydraulic arm 7-2 of the ROV, as shown in detail in FIG. 2B. When the shuttle has been filled, the cover is merely lowered again and the assembly remains leaktight purely under the weight of said cover. The shuttle 10 is then raised to the surface as explained with reference to FIGS. 4-4B. On arriving close to the surface 12, e.g. at a depth of 25 m, the assembly is stabilized, and then divers connect a hose to the top of the shuttle to transfer, preferably by means of a pump, the polluting fluid to the holds of a tanker situated in the immediate vicinity of the shuttle. After it has been emptied, the shuttle is lowered back down to the tank 9 to perform a new cycle of filling and rising to the surface, and this is repeated until the tank is completely empty.

In order to avoid the hull of the wreck deforming while polluting fluid is being transferred to the shuttle, it is advantageous to pierce the wall of the tank with a second device 1 of the invention so as to create a second small first orifice for allowing sea water to pass through freely. Nevertheless, in order to avoid the polluting fluid 8 escaping during the boring proper or during any of the shuttle transfer cycles, it is advantageous to proceed as shown specifically in FIGS. 3A to 3F.

The following additional steps are thus performed:

1a) a base is put into place and anchored, and the bottom wall 6 of the same tank 9 is drilled using a second device 1 of the invention, and a second said first orifice is drilled, preferably through the same wall as the first said first orifice using the above-described method, however, after a second said first orifice has been drilled in said bottom wall, the cutter means 4 of said second device are left in place on the bottom wall so as to keep the second said first orifice 2-1 closed; and then 2a) said large second orifice of the base of said second device is opened and means 14-17 are inserted in the second said first orifice of said drilled bottom wall, which means 14-17 serve to allow sea water to penetrate into the bottom of said tank progressively as said viscous fluid flows from the tank into said shuttle reservoir through said first orifice 1-1.

In step 1a), the crown saw 4-1 is provided at 3 centimeters (cm) from its bottom end with a projection that acts as crown saw retaining means 4-1*b*. By way of example, the projection may be constituted by a molding of elastomer or by a rubber elastic band tightly secured around the outside of said crown saw. At the end of boring, when the disk 1-2 is released and drops to the bottom of the tank, the motor 4-2 is retracted in upward translation, but the crown saw 4-1 is previously disconnected by undoing a latch (not shown) that holds it on the end of the fluted shaft 4-1*c* of said motor, as shown in FIG. 3B. The cover can then be raised by being pivoted as shown in FIG. 3E and the crown saw then provides sealing for the orifice because its own weight is greater than the upward thrust exerted by the polluting fluid on the section of said crown saw, with the elastic band 4-1*b* holding it and preventing it from dropping into the tank 9.

In step 2a), a cannula 14 is inserted that extends down to close to the bottom 6-1 of the tank 9, said cannula being provided with a valve 15 close to its top end, and preferably also with a safety valve 16 serving to avoid any excess pressure in the tank, said cannula sliding as a tight fit inside a coupling piece 17, thus enabling said cannula to be connected in leaktight manner with the second said first orifice. Said coupling piece 17 is at least partially funnel-shaped and said cannula 14 is inserted by force into the inside of said funnel, said cutter means 4-1 plugging said first orifice with the help of the retaining means 4-1*b* until said coupling piece 17 is in leaktight connection with the second large second orifice, after which forcing said cannula and said funnel against said cutter means causes said retaining means 4-1*b* of said cutter means to allow said cutter means to drop into the tank, and said cannula is caused to slide relative to the coupling piece 17 until the bottom end of said cannula comes close to resting on the bottom of the tank, after which said top valve is opened, which valve was previously closed.

Figure 3C:
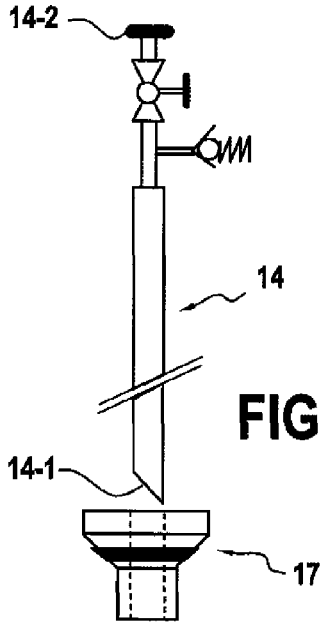
Figure 3D:
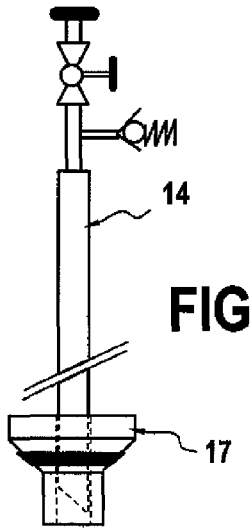
Figure 3E:
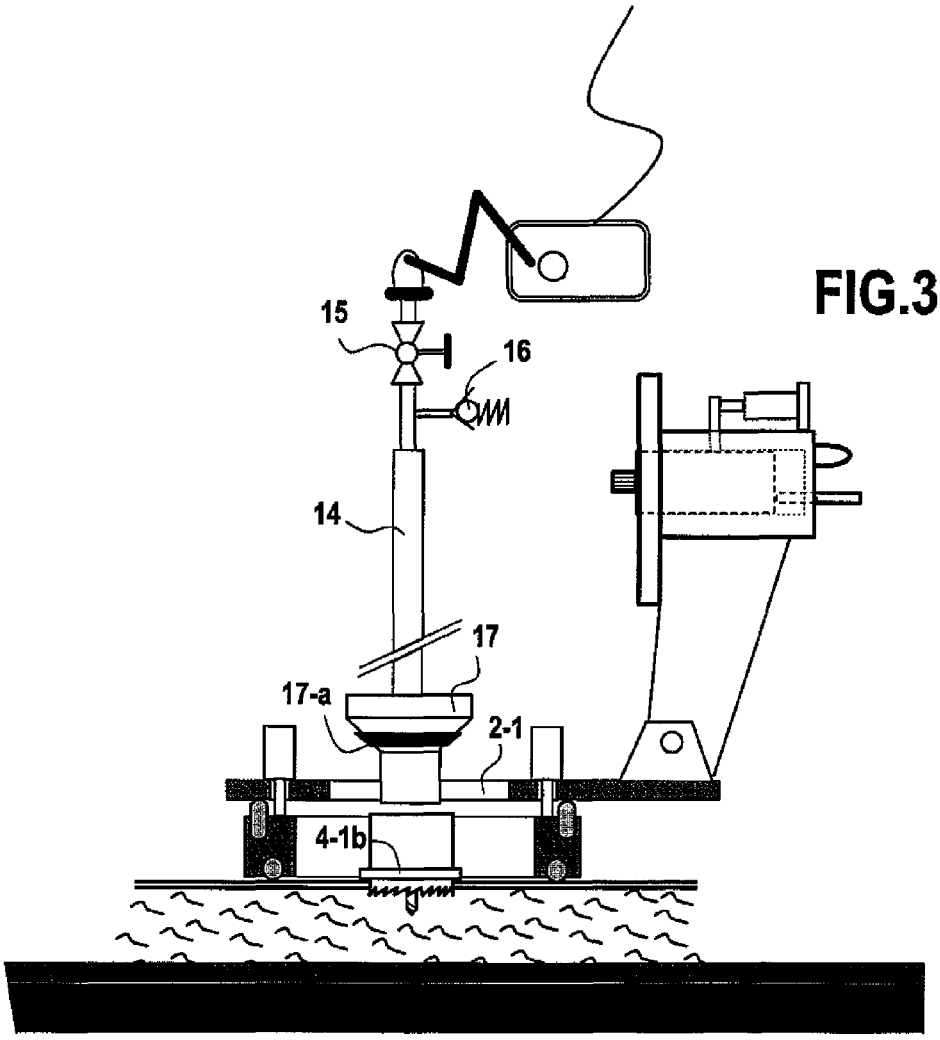
Figure 3F:
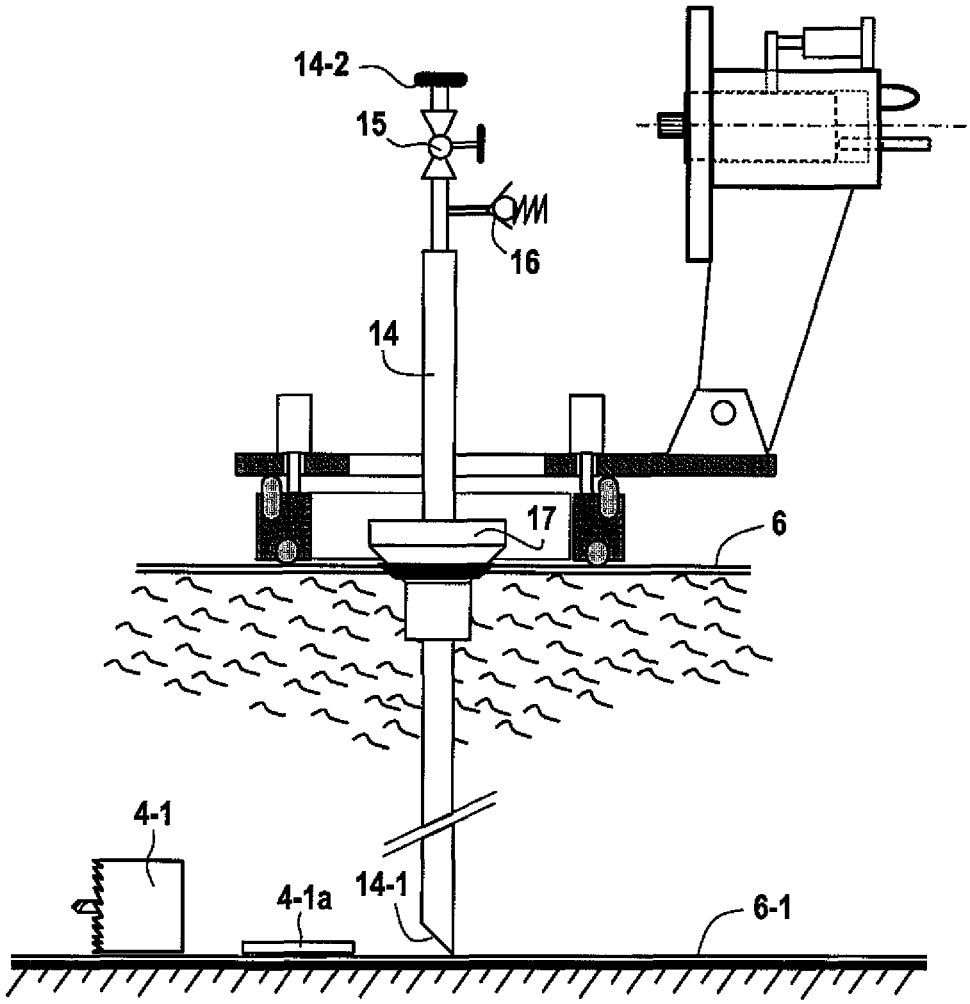

FIGS. 3D to 3E show an injection cannula 14 of length that is about 1 m greater than the total height of the tank 9 to be emptied. The cannula 14 is constituted by a tube with a chamfered bottom end 14-1 and it is provided in its top portion with a valve 15 and with a flange 14-2. A safety valve 16 is advantageously installed on its side so as to avoid any excess pressure in the tank. Said cannula slides as a tight fit through a coupling piece 17 that has a funnel-shaped portion, being provided in its conical portion with an elastomer cone 17-1 with a thickness of 10 mm secured thereto. Said cannula is inserted by force into said funnel without the bottom chamfer 14-1 of the cannula projecting beyond said funnel, as shown in FIG. 3E. The injection cannula 14 together with its funnel 17 is lowered from the surface 12 and the assembly is manipulated with the help of an ROV, so that the assembly takes up a position vertically above the crown saw 4-1. Finally, the cannula and funnel assembly is lowered such that under its own weight it expels the crown saw, which then drops to the bottom 6-1 of the tank, together with the rubber band 4-1*b*. Finally, the cannula is caused to slide until its chamfered bottom end 14-1 rests on the bottom of the tank in the wreck. Throughout this operation, the top valve is in the closed position, but it is opened by the ROV as soon as the operations of loading the shuttle begin. Thus, sea water enters the tank via its bottom and does not disturb transfer of the polluting fluid. The top flange 14-2 at the top of the cannula makes it possible advantageously to connect a sea water injection pump (not shown) suitable for actuation by the ROV and serving to accelerate the process of transferring the polluting fluid, particularly for use with fluids of high viscosity. The discharge valve 16 serves to avoid any undesirable excess pressure in the vessel.

FIG. 4 shows a preferred version of the invention in which the rise of the shuttle reservoir 10 is controlled by a stabilizer device 11 comprising a connection cable 11-1 with a portion of its bottom end weighting it, e.g. by metal blocks 11-2 that are secured to said cable 11-1 by crimping 11-2*a* so as to form a string of "beads" on a cable.

The downward speed of a said shuttle reservoir 10 or the upward speed of said shuttle reservoir 10, as the case may be, is controlled with a stabilizer device 11 comprising at least one connection cable 11-1 extending from the surface, preferably from a ship on the surface, down to said shuttle reservoir 10, to which its end is connected, where appropriate, said connection cable or chain 11-1 having a bottom portion that is weighted, preferably by blocks 11-2 forming a string along said second cable or by bigger and heavier links of said chain, such that the weight of the length of said bottom portion of said cable or chain hanging below its point of connection 10*d* with said shuttle reservoir 10 can be adjusted from the surface, preferably with the help of a winch situated on board a ship on the surface, with the top end of said cable or said chain being wound on or off the winch so as to control the rate at which said shuttle reservoir 10 moves down or up, as the case may be.

Said blocks 11-2 of said cable or said large heavy links of said chain, in said bottom portion of said cable 11-1 or chain are of a shape such that when said cable or said chain is curved, two adjacent blocks or two adjacent heavy links come into abutment one against the other, thereby limiting the local radius of curvature of said cable or said chain.

The shuttle reservoir 10 is kept close to the base 2 by anchor means comprising at least one anchor cable 13 connected to a first attachment point 10*d* fastened to the bottom portion of said reservoir and to at least one second anchor point 13-1 on said wall 6, like the guy ropes of a tent.

Advantageously, when said shuttle reservoir is full, a step of automatically disconnecting said anchor means is performed, which step preferably takes place automatically when the shuttle reservoir has reached a predetermined level of filling, in particular when the reservoir is full or nearly full.

More particularly, at least one said anchor cable 13 cooperates with a first automatic disconnection device on which traction is exerted corresponding to the buoyancy thrust exerted on said shuttle reservoir and its cargo, which traction is transmitted by said anchor cable, said disconnection device having the effect of causing said anchor cable to be disconnected by separating said anchor cable 13 from said base 2 or by breaking said anchor cable, thereby allowing said shuttle reservoir to rise at least in part once said traction reaches a first determined threshold value, preferably when said shuttle reservoir is full of effluent.

More particularly, the operator at the surface is thus warned, by a camera on board the ROV, that filling has finished, and the ROV can release the cable 13, thereby enabling the reservoir to rise towards the surface with its upward movement being under full control because of the chain system 11.

Each block 11-2 has a central body in the form of a prism or a circular cylinder with frustoconical ends 11-2*b* such that when the cable is curved said frustoconical ends of two adjacent blocks come into abutment one against the other, thereby limiting the local radius of curvature to a value greater than R0. Thus, the connection cable 11-1 that is connected to the shuttle reservoir 10 via said first connection point 10*d* at the bottom of the reservoir 10 extends downwards and then moves away therefrom following a circular arc of radius R0 prior to rising vertically or in a catenary configuration at a distance of at least about 2R0 from the side wall of said shuttle reservoir, thereby avoiding any mechanical contact during the upward movement, and thus avoiding damage by friction.

In FIG. 4, the buoyancy Fv of the shuttle reservoir full of hydrocarbon, corresponding to the buoyancy acting on the reservoir and its cargo, is compensated by the weight of the cable to the point where there is a horizontal tangent that corresponds to block 11-2*i*, plus the weight of the blocks 11-2*g* between the reservoir and the lowest block 11-2*i*, i.e. 8.5 blocks in FIG. 4, so that the weight Pe of the assembly then corresponds to the system being in equilibrium.

By way of example, to make FIGS. 4, 4A, and 4B more concrete, the shuttle reservoir 10 has a volume of 250 $m^3$, and when it contains oil with a density of 1011 kilograms per cubic meter ($kg/m^3$) in sea water at 3° C. with density of 1045 $kg/m^3$, it possesses buoyancy of about 8.5 t.

Each of the blocks of the balancing device 11 then has a weight in water of about 1 t.

In FIG. 4A, the top end of the connection cable 11-1 connected to a winch on board a surface ship (not shown) is raised, thereby bringing the block 11-2*g* in FIG. 4 into the bottom horizontal position, thereby reducing the number of heavy blocks under the reservoir to 6.5 blocks, the weight of the assembly opposing the buoyancy Fv is then reduced to Pinf. The resultant Fv+Pinf is then positive in the upward direction and the shuttle reservoir can rise until the force equilibrium of FIG. 4 is achieved.

Similarly, in FIG. 4B, the top end of the connection cable 11-1 is wound out, thereby having the effect of bringing block 11-2*k* into the low horizontal position, thus increasing the number of heavy blocks under the tank to 10.5 blocks, so the weight of the assembly becomes equal to Psup. The resultant of Fv+Psup is then positive in a downward direction and the shuttle reservoir can move back down until the force equilibrium of FIG. 4 is achieved.

Thus, the stabilizer device 11 of the invention presents a stabilizing effect while raising the shuttle reservoir 10. When the surface ship is moving excessively under the effect of swell or departs from being vertically above the position of the shuttle reservoir, these movements have an instantaneous effect only on the region of the blocks around the blocks 11-2*g* to 11-2*k*, with the block 11-2*i* corresponding to the mean value of the oscillations.

Thus, in order to control the upward movement of the shuttle reservoir 10, it suffices to wind the connection cable 11-1 onto the winch on board the ship at the surface 12 at a speed that is compatible with the natural upward speed of said shuttle, said shuttle always naturally seeking to take up its equilibrium position as shown in FIG. 4. In the event of difficulty, it suffices to slow down or stop the winding onto the winch, with the shuttle reservoir then almost immediately finding its equilibrium position while waiting for the winch to start moving again.

By proceeding in this way, the shuttle 10 is always in a safe situation since there is no direct physical connection, i.e. via a taut line such as a cable or a pipe between the surface ship and the wreck lying on the sea bottom.

In the description of the invention, a sealed chamber is described between the cover 3-2 and the bottom wall 6 as being constituted amongst other things by means of a cylindrical wall 3-1 fitted with gaskets 3-1*a* and 3-1*b*, however it would remain within the spirit of the invention for this sealing to be obtained by any other means, such as for example an inflatable rubber torus having an inflation orifice, said torus then taking the place of said wall and the cylindrical gaskets, and providing sealing for the chamber in the same manner.

Similarly, the magnets 5-1 are described as being actuated by hydraulic actuators 5-5 powered and controlled by the ROV 7, however they could equally well be actuated one by one, directly by the manipulator arm 7-2 of said ROV.

The invention claimed is:

1. A device for cutting a small first orifice in a wall at the bottom of the sea and for opening/closing said first orifice, the device comprising a base that has a large second orifice, and further comprising:

anchor means secured to said base and suitable for anchoring said base reversibly on said wall, maintaining said large second orifice at a distance from said bottom wall;

a deformable stopper secured to said base and enabling said large second orifice to be opened or closed depending on whether the stopper is respectively in its open or closed position on the base;

deformer means for deforming said stopper, the deformer means being secured to said base, being independent of said anchor means, and being suitable for deforming said stopper to create sealing between said second orifice and said bottom wall after said base has been anchored on said bottom wall; and circular cutter means secured to said base and suitable:

for moving through said large second orifice in the base to cut a said small first orifice that is circular beneath said large second orifice when said stopper is in the closed position and said base is anchored on said bottom wall; and for disengaging from said large second orifice to allow said first orifice to be opened when said stopper is in the open position.

2. The device according to claim 1, wherein said deformer means for deforming said stopper are suitable for creating sealing by deforming said stopper between said large second orifice and said bottom wall after said base has been anchored on a said bottom wall that is not uniformly plane as a result of local deformation or of the presence of a bead of welding.

3. The device according to claim 1, wherein:

said base includes a platform including a said large second orifice; and said stopper comprises:

a cylindrical wall defining a said cylindrical chamber disposed axially relative to said large second orifice on the underside of said platform, said cylindrical wall including a top elastomer gasket on its top edge suitable for establishing sealing between said platform and said cylindrical wall, and a bottom elastomer gasket on its bottom edge suitable for establishing sealing between said cylindrical wall and said bottom wall; and a cover-forming plate and tilt means for tilting said cover mounted on said platform, titling said cover enabling said large second orifice to be closed in sealed manner; and said cutter means are secured to said cover and comprise a crown saw or bit mounted under said cover and a motor mounted on said cover enabling said crown saw or bit to be caused to slide in the axial direction of said large second orifice and to be actuated in rotation about said axis.

4. The device according to claim 3, wherein said cylindrical wall is connected to said platform by fastener means constituted by controlled spacer means for spacing said cylindrical wall apart from said platform and suitable for spacing said cylindrical wall away from said platform to enable said cylindrical wall to be pressed in sealed manner against said wall at the bottom of the sea so as to create a sealed cylindrical chamber between said large second orifice and said bottom wall when said base is anchored on said bottom wall and said cover is in the closed position, by adjusting the force with which the cylindrical wall is pressed against the bottom wall and said elastomer gaskets are compressed.

5. The device according to claim 4, wherein:

the fastener means are constituted by controlled spacer means for spacing said cylindrical wall relative to said platform, which fastener means are localized and act on three points disposed in a triangle around said large second orifice; and said spacer means are suitable for co-operating with said elastomer gaskets by adjusting the force with which the cylindrical wall is pressed against the bottom wall to create a sealed chamber between the bottom wall, the cylindrical wall and said platform surmounted by said cover in the closed position, whereby:

in an initial close-together position, said top elastomer gasket is compressed; and in a final position of said cylindrical wall spaced apart from said platform, said top elastomer gasket has expanded while maintaining a sealed connection between said cylindrical wall and said platform, and said bottom elastomer gasket is compressed, said cylindrical wall being in sealed connection with said bottom wall.

6. The device according to claim 4, wherein said spacer means comprise actuators or bolts co-operating with screw threads of third orifices through said platform.

7. The device according to claim 1, wherein said anchor means comprise block magnets.

8. The device according to claim 7, wherein said block magnets enable said platform to be secured to said bottom wall, said magnets then co-operating with said platform via three bearing points disposed in a triangle around said large second orifice.

9. The device according to claim 5, wherein said anchor means comprise block magnets that are disposed around said cylindrical wall.

10. The device according to claim 8, further comprising four magnets disposed in a rectangle and co-operating with said platform via three zones:

two first magnets being mounted securely to the underface of said platform and on one side of said rectangle; and two second magnets being disposed outside said platform being connected to each other by a connection arm hinged to pivot about a middle transverse axis embodied by at least a first end of a second connection arm secured to said platform;

said magnets being activatable by actuating respective levers.

11. The device according to claim 1, wherein at least some of said cutter means, said anchor means of the base, said fastener means for fastening said cylindrical wall to said platform, and said tilt means for tilting said cover are suitable for being actuated by an ROV.

12. A method of placing and anchoring a base on a substantially horizontal wall at the bottom of the sea and of cutting a said bottom wall with the help of a device according to claim 1, wherein the following successive steps are performed:

1) lowering a said device according to claim 1 from the surface, said stopper being in its position for closing said large second orifice; and 2) anchoring said base on said bottom wall; and 3) deforming said stopper in such a manner as to establish sealing by deformation of said stopper between said large second orifice and said bottom wall after said base has been anchored on said bottom wall; and 4) actuating said cutter means in longitudinal sliding towards said bottom wall and in rotation to cut a said first orifice in said wall, said stopper being in said closed position.

13. The method according to claim 12, wherein, after said cutting operation, the following subsequent step is performed:

5) actuating said cutter means to slide longitudinally in the opposite direction while maintaining said cylindrical wall, where appropriate, pressed against said bottom wall in sealed manner, said stopper continuing to be in said position closing said large second orifice.

14. A method of recovering a viscous fluid that is lighter than water, such as a polluting effluent, the fluid being contained in a tank of a sunken and/or damaged ship lying on the sea bottom, the method comprising the following steps:

1) performing the method of placing and anchoring a base and drilling the wall of said tank by a method of placing and anchoring a base on a bottom wall and cutting said bottom wall in accordance with claim 13;

2) lowering a shuttle reservoir from the surface to above said base;

3) anchoring said shuttle reservoir on said bottom wall or said base so that the bottom opening of said shuttle reservoir is positioned close to and above said large second orifice of said base;

4) opening said large second orifice of said base with said stopper in said open position, and allowing said fluid contained in the tank to flow naturally into said shuttle reservoir through the bottom opening of said shuttle reservoir;

5) when said shuttle reservoir is full of fluid, raising said shuttle reservoir to the surface after closing said small first orifice and said large second orifice in said base with the help of said stopper in said closed position;

6) storing said shuttle reservoir full of fluid in a surface ship and/or emptying said shuttle reservoir into said ship, and/or transporting it to a site for emptying; and 7) where appropriate, repeating steps 1) to 6) with the same shuttle reservoir or with another shuttle reservoir until the desired quantity has been recovered, said cutter means and said stopper continuing to remain secured to said base anchored on said bottom wall.

15. The method according to claim 14, wherein the following additional steps are performed:

1a) a method of placing and anchoring a base and of cutting the bottom wall of the same tank is performed with the help of a second device for anchoring a base and cutting a wall in accordance with claim 1, and cutting a second said first orifice, preferably in the same wall as the first said first orifice using a method of claim 12; then 2a) opening said large second orifice in the base of said second device and introducing means into the second said first orifice in said drilled bottom wall, said means enabling sea water to be introduced into the bottom of said tank as said viscous fluid flows from the tank towards said shuttle reservoir through the first said first orifice.

16. The method according to claim 15, wherein in step 2a), a cannula is inserted that extends to the proximity of the bottom of the tank, said cannula being provided with a valve close to its top end, and preferably also a safety valve enabling any excess pressure in the tank to be avoided, said cannula sliding as a tight fit through a coupling piece, which coupling piece provides a sealed coupling between said cannula and the second said first orifice.

17. The method according to claim 16, wherein:

after step 1a), of cutting a second said first orifice in said bottom wall, the cutter means of the second said device are left in place on the bottom wall so as to keep the second said first orifice closed by said cutter means plugging said first orifice with the help of retaining means, then in step 2a), said coupling piece is at least partially funnel-shaped and said cannula is introduced by force into said funnel until said coupling piece is in sealed connection with the second said large second orifice, and then said cannula is caused to slide relative to said coupling piece by forcing said cannula against said cutter means until said retaining means give way and allow said cutter means to drop into the tank, and then continuing to cause said cannula to slide until the bottom end of said cannula comes into the proximity of or rests against the bottom of the tank, and then opening said top valve, which, until then, has been in a closed position.

18. The method according to claim 14, wherein said shuttle reservoir comprises:

a flexible or rigid main envelope having a cylindrical peripheral wall surmounted by a rigid dome presenting a bullet-shaped profile in vertical section, said dome preferably containing buoyancy elements such as syntactic foam enabling the return of the shuttle to the surface merely under buoyancy to be controlled, preferably by offsetting the buoyancy center of said fluid-filled shuttle reservoir upwards relative to its apparent center of gravity in water.

19. The method according to claim 14, wherein the downward speed of a said shuttle reservoir, or the upward speed of said shuttle reservoir, as appropriate, is controlled with a stabilizer device comprising at least one connection cable or chain extending from the surface, preferably from a ship on the surface, down to said shuttle reservoir, where appropriate, to which the end of the stabilizer device is connected, said connection cable or chain including a bottom portion that is weighted, preferably by blocks forming a string along said second cable or by large heavy links in said chain, in such a manner that the weight of the length of said bottom portion of said cable or chain hanging under its point of connection to said shuttle reservoir can be adjusted from the surface, preferably with the help of a winch situated on board a surface ship and on which the top end of said cable or said chain is wound or on or off, so as to control the upward or downward speed respectively of said shuttle reservoir, as appropriate.

* * * * *